US012157032B2

(12) United States Patent
Forbes

(10) Patent No.: US 12,157,032 B2
(45) Date of Patent: Dec. 3, 2024

(54) ARTIFICIAL TERRAIN TREADMILL BELTS AND TREADMILLS

(71) Applicant: Erin Forbes, Hanover, PA (US)

(72) Inventor: Erin Forbes, Hanover, PA (US)

( * ) Notice: Subject to any disclaimer, the term of this patent is extended or adjusted under 35 U.S.C. 154(b) by 124 days.

(21) Appl. No.: 17/933,863

(22) Filed: Sep. 21, 2022

(65) Prior Publication Data

US 2023/0104643 A1 Apr. 6, 2023

Related U.S. Application Data

(60) Provisional application No. 63/251,860, filed on Oct. 4, 2021.

(51) Int. Cl.
*A63B 22/02* (2006.01)

(52) U.S. Cl.
CPC ..... *A63B 22/0285* (2013.01)

(58) Field of Classification Search
CPC ..... A63B 22/0285
See application file for complete search history.

(56) References Cited

U.S. PATENT DOCUMENTS

2013/0281241 A1* 10/2013 Watterson ..... A63B 22/0285 474/237
2022/0280857 A1* 9/2022 Watterson ..... H04N 5/2228

FOREIGN PATENT DOCUMENTS

CN 2870907 Y * 2/2007 ..... A63B 22/02
CN 106669098 A * 5/2017 ..... A63B 22/02
CN 106999749 A * 8/2017 ..... A61H 15/00
DE 202010008481 U1 * 11/2010 ..... A63B 22/0235
EP 3180477 B1 * 5/2019 ..... E01C 13/08
JP H08763 A * 1/1996 ..... A63B 2220/78
KR 100581020 B1 * 5/2006 ..... A63B 69/3661
KR 100912011 B1 * 8/2009 ..... A63B 22/02

OTHER PUBLICATIONS

Tuff Tread Fitness & Performance_Facebook, Tuff Tread Fitness & Performance, Tuff Tread Extra Wide Treadmill, Oct. 16, 2018, Facebook, Video, pp. 1-2 (Year: 2018).*

* cited by examiner

*Primary Examiner* — Sundhara M Ganesan
*Assistant Examiner* — Jacqueline N L Loberiza
(74) *Attorney, Agent, or Firm* — Brennan, Manna & Diamond, LLC

(57) ABSTRACT

The present invention relates to a treadmill belt having an artificial grass, turf, and/or rocky surface. In some embodiments, the belt may have rocky terrain. The belt is configured to be removably attached to existing treadmill machines or can be integrated to specifically designed machines. A treadmill with attached tread belt features a screen that enables users to choose a specific type of running surface available on the belt. In some embodiments, the screen displays a representation or imitation of the specific surface disposed on the belt. The turf can be raised or lowered to simulate different terrain and grass heights to practice running on hiking trails and other elevated outdoor areas. The treadmills come in different sizes, configurations, and sizes and can be used in athletic training and simulation. The treadmill helps prevent injuries to users when transitioning from running on a treadmill to outdoor terrain surfaces.

18 Claims, 6 Drawing Sheets

ARTIFICIAL TERRAIN TREADMILL BELTS AND TREADMILLS

CROSS-REFERENCE TO RELATED APPLICATION

The present application claims priority to, and the benefit of, U.S. Provisional Application No. 63/251,860, which was filed on Oct. 4, 2021 and is incorporated herein by reference in its entirety.

FIELD OF THE INVENTION

The present invention relates generally to the field of treadmills and tread belts. More specifically, the present invention relates to a novel treadmill belt comprised of an artificial grass, turf, and/or rocky surface. The belt may have rocky terrain or any other outdoor terrain running surface. The belt can be attached to existing treadmill machines or specifically designed machines. A treadmill incorporating the belt has a screen enabling users to choose a specific type of running surface available on the belt while enabling users to raise and lower the turf to simulate different terrain and grass heights. Accordingly, the present disclosure makes specific reference thereto. Nonetheless, it is to be appreciated that aspects of the present invention are also equally applicable to other like applications, devices, and methods of manufacture.

BACKGROUND

By way of background, aerobic exercise is a form of exercise that improves cardiovascular health by reducing blood pressure. Aerobic exercise generally involves low intensity physical exertion over a long duration of time. Typically, the human body can adequately supply enough oxygen to meet the body's demands at the intensity levels involved with aerobic exercise, therefore, such exercises are known as aerobic exercise. The most prominent aerobic exercise machine is a treadmill, which is a machine that has a running deck attached to a support frame. The running deck is configured to support the weight of a person using the machine and incorporates a tread belt that is driven by a motor. A user can run or walk in place on the tread belt by running, hiking, or walking at the tread belt's speed.

Conventional treadmills have tread belts made of standard rubber and PVC materials to help maintain a secure grip with shoes and sneakers while walking and running on the treadmill. However, when individuals run outdoors, they run on different types of terrains such as grass, rocky terrain, hilly areas, and more which are completely different from the tread belts on the treadmills. As a result, when individuals who generally run-on treadmills, walk or run outdoors, find a jarring transition between the terrains and this may cause injuries to occur due to individuals not being prepared for running on dirt, gravel, sand, and more. Therefore, individuals desire improved treadmill belts that can mimic different outdoor terrains.

Standard treadmills allow users to choose inclination, speed, and duration of the running, hiking, or walking, but do not allow them to choose a specific tread belt surface for walking and running. Individuals desire a modified treadmill that allows them to choose a specific type of running surface available on the tread belt.

Therefore, there exists a long felt need in the art for a modified treadmill belt that features an outdoor terrain surface. There is also a long felt need in the art for a treadmill tread belt that is configured to mimic a specific type of outdoor terrain. Additionally, there is a long felt need in the art for a treadmill tread belt that improves walking, hiking, jogging, and running on a treadmill enabling users to adjust their workouts to accommodate a specific type of terrain surface. Moreover, there is a long felt need in the art for a treadmill that allows individuals to choose a specific type of running surface available on the tread belt. Further, there is a long felt need in the art for a treadmill tread belt that features an artificial grass, turf, and/or rocky surface. Furthermore, there is a long felt need in the art for improved tread belt that can be retrofitted to existing treadmills or can be integrated in newly designed treadmills. Finally, there is a long felt need in the art for a treadmill tread belt that helps prevent injuries when transitioning from running on a treadmill to outdoor terrain.

The subject matter disclosed and claimed herein, in one embodiment thereof, comprises a treadmill configured to provide a tread belt featuring an artificial grass, turf, and/or rocky surface. The treadmill helps in preventing injuries when transitioning from running on a treadmill to outdoor terrain surfaces. The treadmill comprising a tread belt, the tread belt having a top surface imitating artificial grass, turf, and/or rocky surface, a channel disposed on a pair of posts for elevating the tread belt to simulate a hilly area, a screen attached to said posts, the screen is configured to display the artificial grass, turf, and/or rocky running or hiking surface, wherein the turf is raised or lowered to simulate differing grass heights. The tread belt can be attached (i.e., retrofitted) to existing treadmill machines or specifically designed machines.

In this manner, the treadmill and the tread belt of the present invention accomplish all of the forgoing objectives and provides users with a modified treadmill belt featuring an artificial grass surface, turf surface, and/or rocky terrain, and more. The tread belt improves walking, hiking, jogging, and running on the treadmill, enabling users to adjust their workouts to accommodate a specific type of terrain surface to mimic that of the outdoors. The treadmill helps prevent injuries when transitioning from running on a treadmill to outdoor terrain surfaces.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a tread belt for a treadmill. The tread belt further comprising a top surface imitating artificial grass, turf, and/or rock, a bottom shock pad for providing cushion to the feet of a user running, hiking, or walking on the tread belt; yarn extending on the top surface for providing the artificial grass look, wherein the tread belt is configured to be integrated or removably attached to the treadmill.

In yet another embodiment, a unique tread belt for a treadmill is disclosed. The tread belt further comprising a top surface imitating a rocky terrain, a bottom shock pad for providing cushion to feet of a user running, hiking, or walking on the tread belt; small and uneven rocks disposed on the top surface for providing the rocky terrain look, wherein the tread belt is configured to be integrated or removably attached to the treadmill.

In yet another embodiment, a treadmill configured to prevent injuries to users when transitioning from running or hiking on the treadmill to outdoor terrain is disclosed. The treadmill comprising a tread belt, the tread belt having a top surface imitating turf or rocky terrain, a channel disposed on a pair of posts for raising the tread belt, a screen attached to said posts, the screen is configured to display the running surface provided by the tread belt wherein display on the screen can be changed using a plurality of buttons disposed on a console.

In yet another embodiment, a treadmill configured to provide a tread belt featuring an artificial grass, turf, and/or rocky surface is disclosed. The treadmill comprising a tread belt, the tread belt having a top surface imitating artificial grass, turf, and/or rocky surface, a channel disposed on a pair of posts for elevating the tread belt to simulate a hilly area, a screen attached to said posts, the screen is configured to display the artificial grass, turf, and/or rocky running surface, wherein the turf is raised or lowered to simulate differing grass heights.

In yet another embodiment, the treadmill is configured to be used in a sports locker room and the tread belt has barriers disposed thereon.

In yet another embodiment, the tread belt may have at least two different types of running surfaces.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
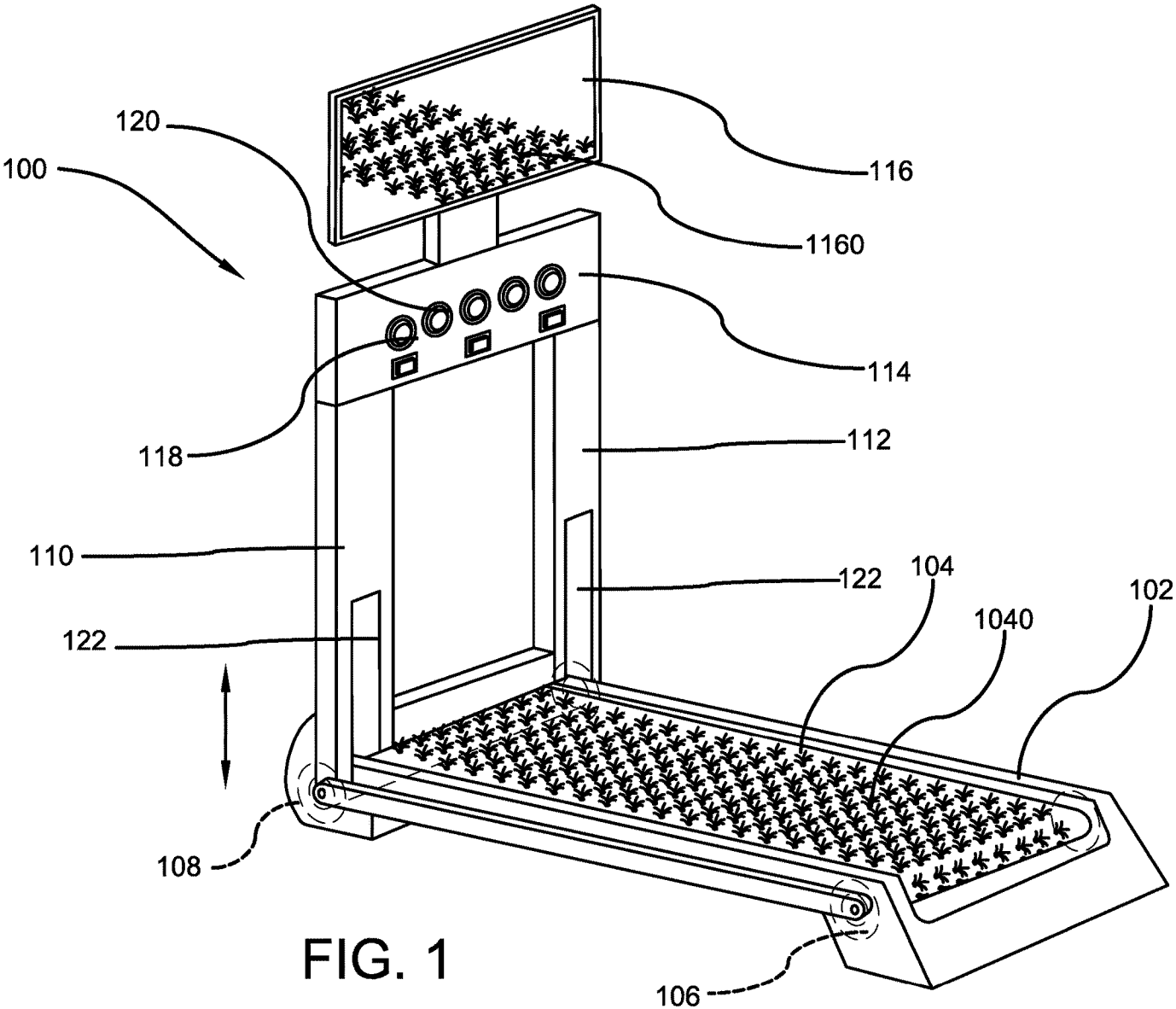
FIG. 1 illustrates a perspective view of one potential embodiment of a turf and terrain treadmill device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a modified treadmill belt that features an outdoor terrain surface. There is also a long felt need in the art for a treadmill tread belt that is configured to mimic a specific type of outdoor terrain. Additionally, there is a long felt need in the art for a treadmill tread belt that improves walking, hiking, jogging, and running on a treadmill enabling users to adjust their workouts to accommodate a specific type of terrain surface. Moreover, there is a long felt need in the art for a treadmill that allows individuals to choose a specific type of running surface available on the tread belt. Further, there is a long felt need in the art for a treadmill tread belt that features an artificial grass, turf, and/or rocky surface. Furthermore, there is a long felt need in the art for improved tread belt that can be retrofitted to existing treadmills or can be integrated in newly designed treadmills. Finally, there is a long felt need in the art for a treadmill tread belt that helps prevent injuries when transitioning from running, hiking, or walking on a treadmill to outdoor terrain.

The present invention, in one exemplary embodiment, is a tread belt for a treadmill. The tread belt further comprising a top surface imitating turf, a bottom shock pad for providing cushion to the feet of a user running, hiking, or walking on the tread belt; yarn extending on the top surface for providing the artificial grass look, wherein the tread belt is configured to be integrated or removably attached to the treadmill. The height of the yarn is configured to be adjusted for simulating differing grass heights and elevations.

Referring initially to the drawings, FIG. 1 illustrates a perspective view of one potential embodiment of the turf and terrain treadmill device of the present invention in accordance with the disclosed architecture. The turf and terrain treadmill device 100 of the present invention is designed as an improved treadmill 100 for improving walking, hiking, jogging, and running, enabling users to adjust their workouts to accommodate a specific type of terrain surface on tread belt to mimic that of the outdoors. More specifically, the treadmill 100 includes a running deck 102 having a turf and terrain tread belt or tread area 104. The tread belt or tread area 104 provides a running surface for a user and has a top surface 1040 including artificial grass, turf, and/or rocky disposed thereon. In the present embodiment, the tread belt or tread area 104 is disposed between a front pulley 106 and a rear pulley 108. The pulleys 106, 108 are configured to rotate enabling the tread belt or tread area 104 to move while providing sufficient tension to support a user walking or running on the treadmill 100.

The top surface 1040 is configured to imitate grass or uneven terrain to enable a user to simulate walking outdoors on uneven ground, fields, paths, trails, and more. The artificial grass on the top surface can have a height from about 50 mm to about 130 mm. Further, the height of the grass can be adjusted as described later in the disclosure. The treadmill 100 has a pair of posts 110, 112 for supporting a console 114 and a screen 116. The screen 116 is configured to display a representation 1160 of the artificial turf surface 1040, enabling users to be virtually walking, hiking, or running on paths, trails, and/or fields (i.e., uneven terrain).

In one exemplary embodiment, the console 114 is configured to provide standard functions like increasing and decreasing speed of the tread belt or tread area 104 or elevating the tread belt or tread area 104. An adjustment button 118 on the console 114 is configured to increase and decrease thickness of the top surface 1040 as per preference of a user using the treadmill 100. The turf is raised or lowered to simulate differing grass heights and elevations. A height adjustment button 120 disposed on the console 114 is configured to raise the running deck 102 along a channel 122 positioned on the posts 110, 112 to adjust the angle of inclination of the tread belt or tread area 104.

It should be noted that the turf tread belt or tread area 104 is removably attached to the running deck 102 and can be replaced with a tread belt simulating any other outdoor terrain such as sand, trails, gravel, and more. Accordingly, the screen 116 is configured to represent the top surface of the tread belt enabling a user to view and feel running and/or walking on an outdoor terrain.

Advantages of the turf and terrain treadmill 100 of the present invention is that a user running, hiking, or walking on the tread belt or tread area 104 does not feel a jarring transition when moving to running, hiking, or walking on actual outdoor terrain and thus prevents injuries. Further, based on preferences of a user, a tread belt with any type of outdoor terrain can be used in the treadmill 100.

Figure 2:
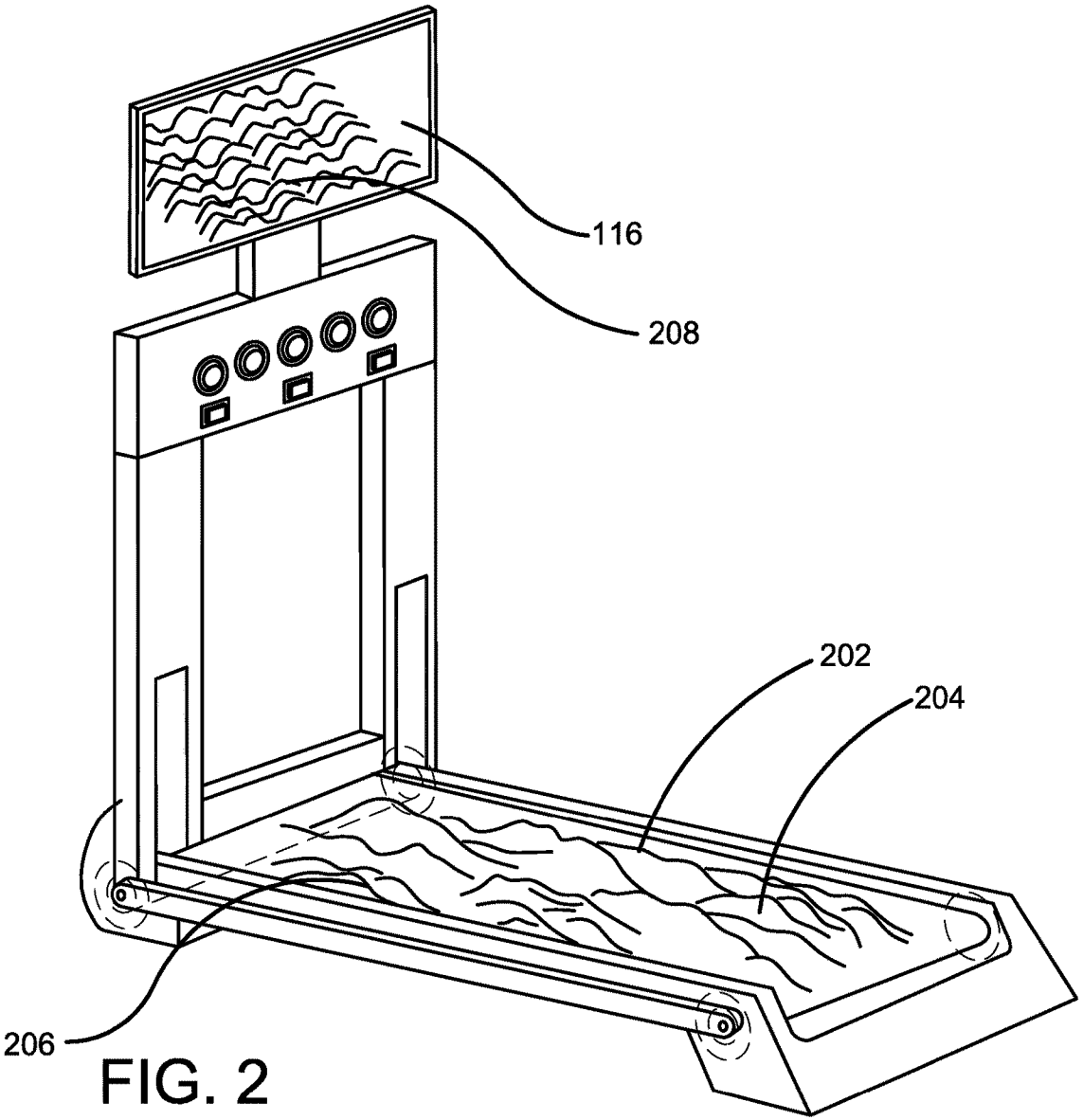
FIG. 2 illustrates the turf and terrain treadmill device of FIG. 1 being equipped with a terrain tread belt in accordance with the disclosed architecture.

FIG. 2 illustrates the turf and terrain treadmill device of FIG. 1 being equipped with a terrain tread belt in accordance with the disclosed architecture. In the present embodiment, the tread belt 202 includes a rocky top surface 204 having a plurality of uneven or unequal sized rocks 206 for imitating a rocky terrain. The screen 116 is configured to display a rocky terrain representation 208 along with hills or any other related scenery enabling a user using the treadmill 100 to feel as if the user is running, hiking, or walking on outdoor rocky terrain.

The rocky tread belt 202 is configured to be in a raised or inclined position or a flat position as per preferences of a user and is configured to be raised or inclined along the channel 122 simulating a hilly area for the user. It should be appreciated that instead of the rocks 206, the tread belt can have gravels or pebbles to imitate a different outdoor terrain.

Figure 3:
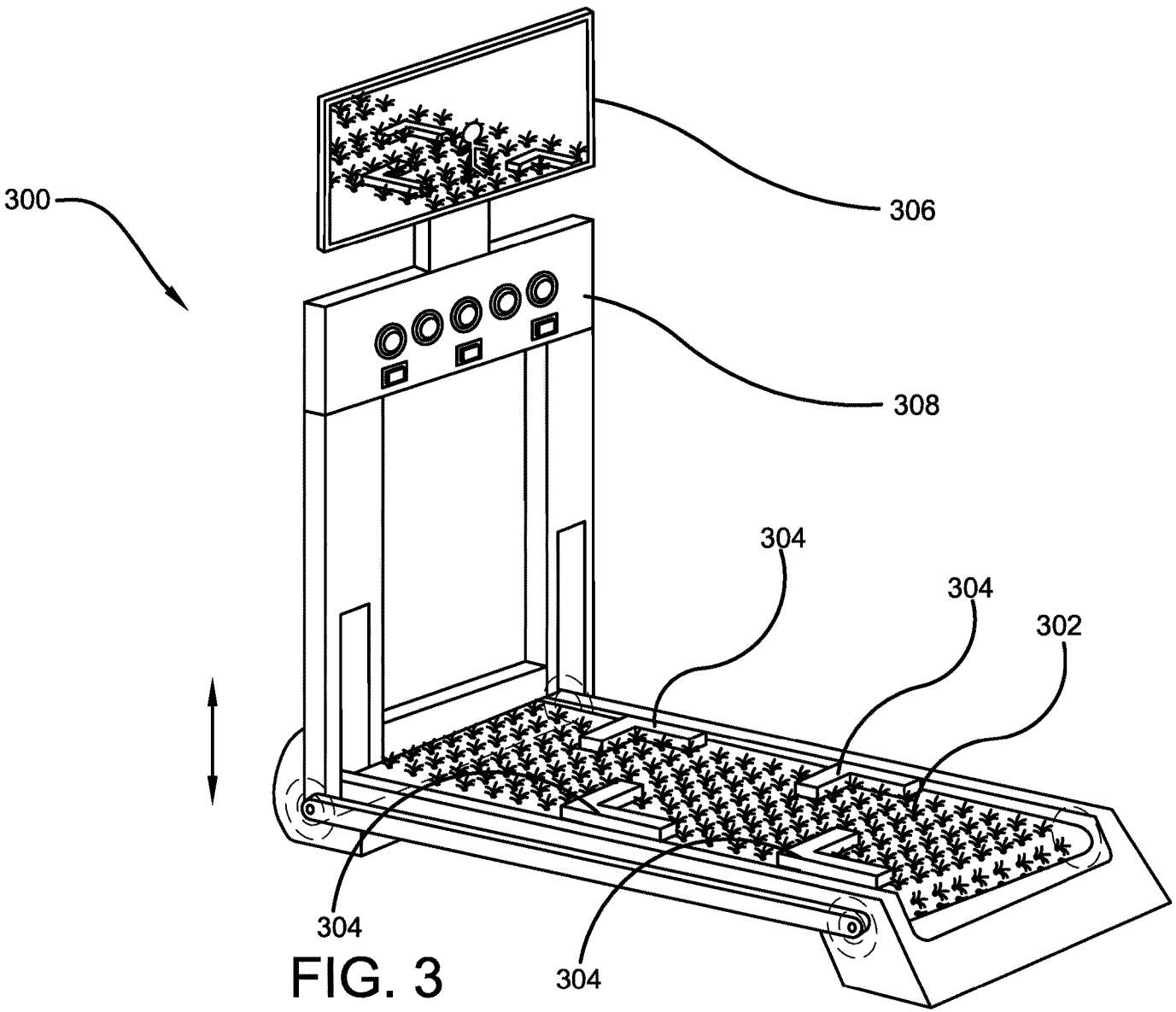
FIG. 3 illustrates a perspective view of another embodiment of the improved treadmill of the present invention having barriers on the tread belt in accordance with the disclosed architecture.

FIG. 3 illustrates a perspective view of another embodiment of the improved treadmill of the present invention having barriers on the tread belt in accordance with the disclosed architecture. In the present embodiment, the treadmill 300 has a tread belt 302 imitating artificial grass, turf, and/or rocky terrain and has a plurality of barriers 304. Although, the treadmill 300 is shown to be of a conventional size, however, the treadmill 300 can be of a bigger size enabling the treadmill 300 to be used in a sports locker room or for training of athletes and sportspersons.

Figure 4:
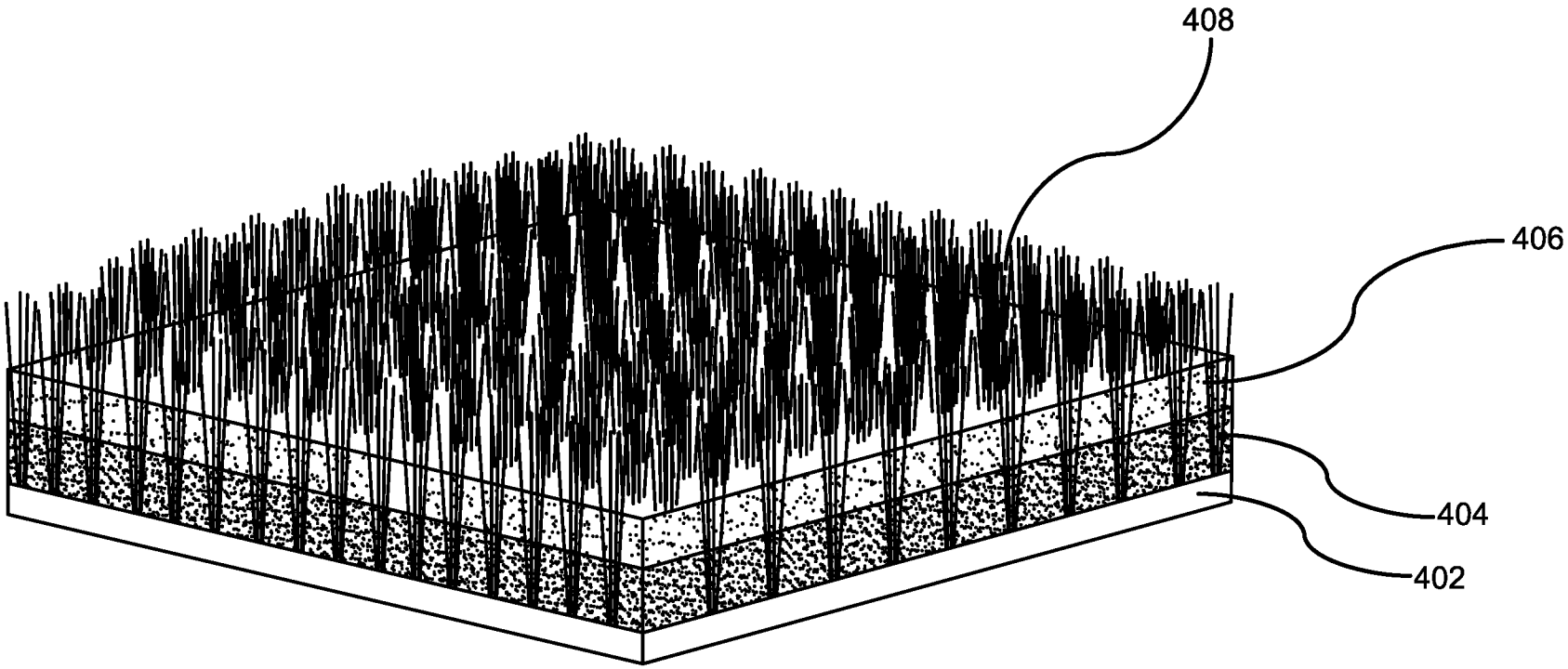
FIG. 4 illustrates a cross sectional view of the artificial grass tread belt configured to be used in the treadmill in accordance with the disclosed architecture.

The number of the barriers 304 can range from two to four depending on the user requirements and the tread belt size and can be used by two or more users for running, hiking, or walking. The screen 306 is attached to the console 308 and is configured to display the barriers 304 and the users running on the treadmill 300. In some embodiments, the users can compete between each other while running on the treadmill 300 and are displayed on the screen 306. FIG. 4 illustrates a cross-sectional view of the artificial grass tread belt or tread area 104 configured to be used in the treadmill 100, 300 in accordance with the disclosed architecture. The belt or tread area 104 has a bottom shock pad 402 on which a backing 404 is disposed. A thick infill 406 is disposed on the backing 404 and the yarn 408 extends out from the infill 406. The yarn 408 is non-harsh and soft to the touch and can be of polyamide nylon/nylon 6.6, Polyethylene (PE), or Polypropylene (PP).

The purpose of shock pad 402 is to provide cushioning to users during running, walking, or falling. The shock pad 402 is prepared of a closed-cell polymer alloy like polyurethane. In one exemplary embodiment, the shock pad 402 is from about 15 mm to about 25 mm in height and perforated.

Figure 5A:
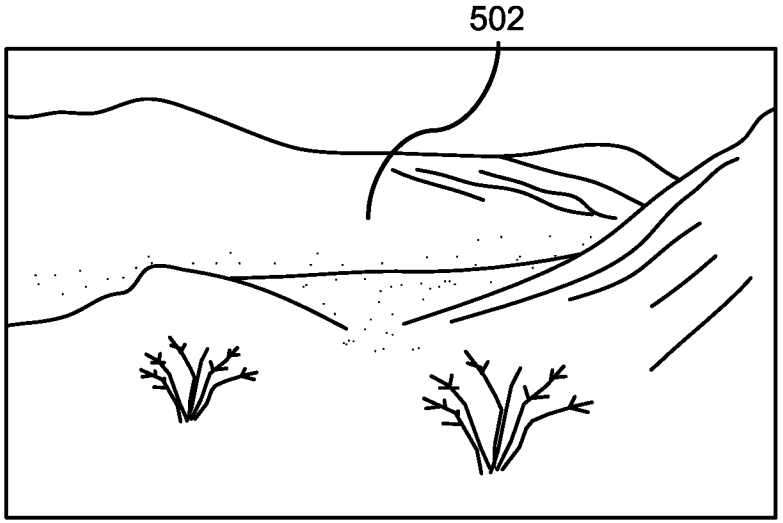
FIGS. 5A, 5B, and 5C illustrate perspective views of exemplary displays shown by screen disposed on the treadmills of various embodiments of the present invention in accordance with the disclosed architecture.
Figure 5B:
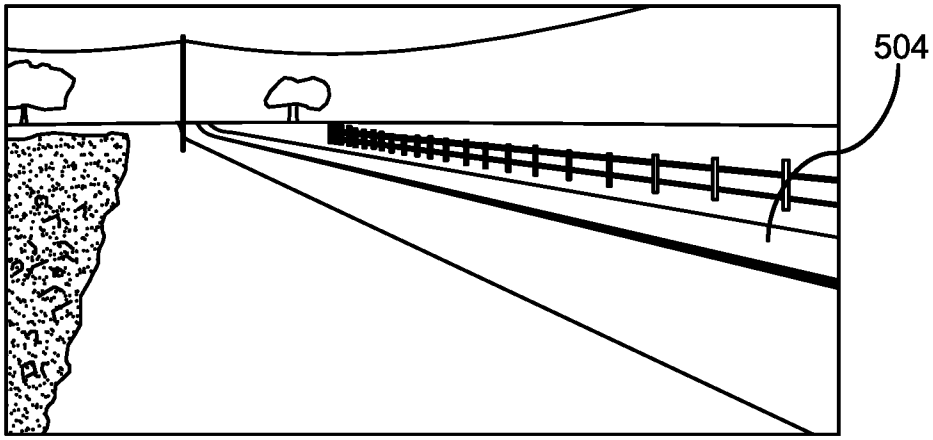
Figure 5C:
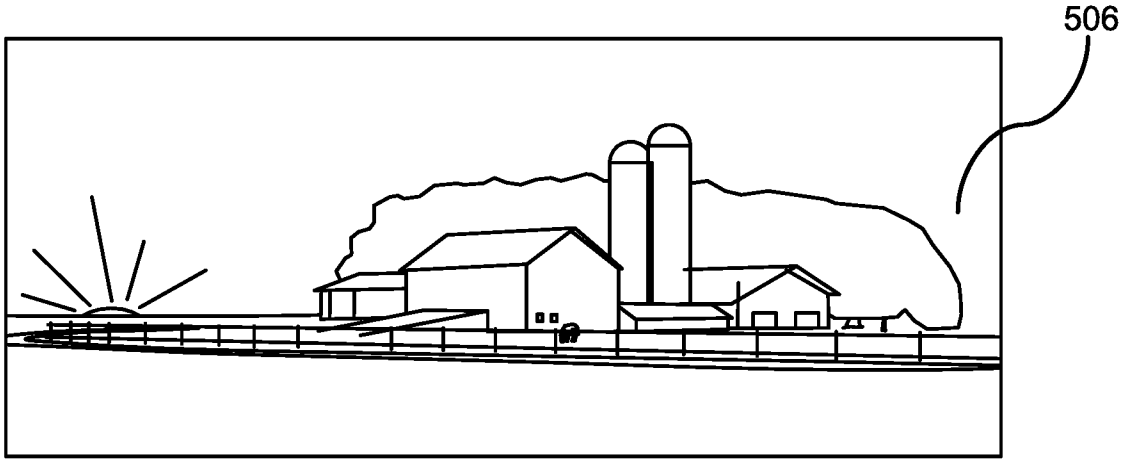

FIGS. 5A, 5B, and 5C illustrate perspective views of exemplary displays shown by the screen disposed on the treadmills of various embodiments of the present invention in accordance with the disclosed architecture. As illustrated, in FIG. 5A, a hilly area 502 is displayed on the screen which can be automatically or manually chosen by a user using the treadmill. The view of the hilly area 502 can be changed by the user using the interactive screen.

In FIG. 5B, a country road 504 is displayed by the screen. The country road 504 may represent an artificial turf or can also represent a rocky artificial turf terrain as per preferences of a user. In FIG. 5C, a farm 506 is displayed on the screen and can include sunset or sunrise settings using the interactive screen based on preferences of a user. It should be appreciated that the console of the treadmill can be used for changing the display on the screen and can visually imitate the tread belt used in the treadmill.

In some embodiments of the present invention, the tread belts, or tread areas, of various embodiments can be designed in bigger sizes (i.e. width×length), such as, a 10'×10', a 10'×20', a 6'×10', a 4'×10', a 4'×6', and more sizes, to be used in sports locker rooms for athletic training. The tread belts are removably attached or integrated into specially designed treadmills that may or may not have screens. Further, the tread belts can be used for a single player for improving agility or can be used with multiple players as opponents while running on the tread belt. The tread belt and treadmills can be used for training players for indoor football, soccer, rugby, and more and is useful for team practice in an indoor environment.

Figure 6:
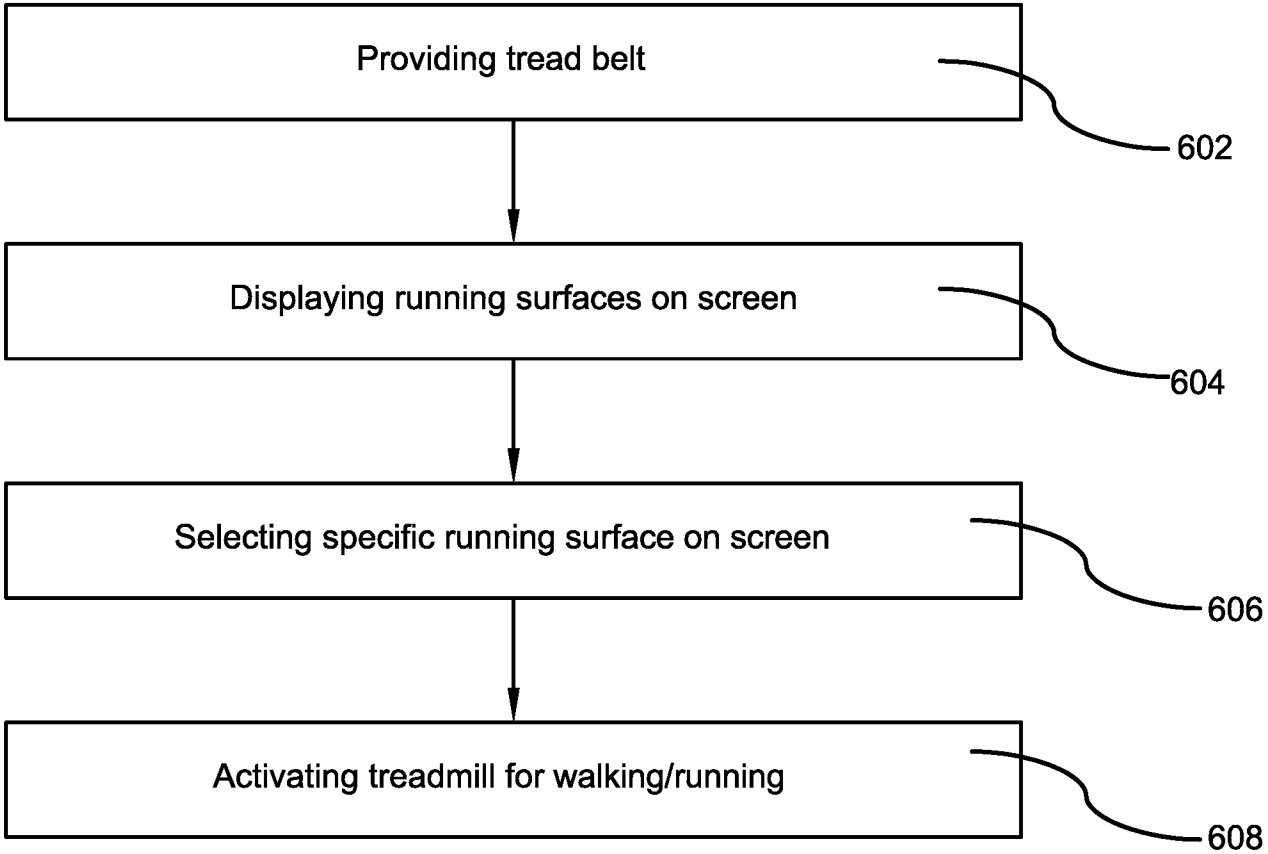
FIG. 6 illustrates a flow diagram depicting a process of choosing a specific type of running surface available on tread belt in accordance with the disclosed architecture.

FIG. 6 illustrates a flow diagram depicting a process of choosing a specific type of running surface available on a tread belt in accordance with the disclosed architecture. Initially, a tread belt is provided that has a specific type of running surface (Step 602). Then, a plurality of available running surfaces are displayed on the screen of the treadmill in which the tread belt is integrated (Step 604). A display can be chosen for viewing which simulates the running surface of the tread belt. Thereafter, the specific type of the running surface available on the belt is chosen by a user (Step 606). Finally, the treadmill is activated enabling the user to walk, hike, or run on the chosen running surface (Step 608).

The treadmills and the tread belts of the present invention can come in various designs, sizes, and configurations and can replace conventional treadmills in a cost-effective manner. Further, the invention enables users to raise and lower the turf to simulate different terrain and grass heights to practice running on hiking trails and other elevated outdoor areas.

Tread belts can be attached to existing treadmill machines or specifically designed machines with these belts as attachments able to be switched out often for sport themes and type of training desired.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "treadmill", "turf and terrain treadmill device", and "improved treadmill device" are interchangeable and refer to the turf and terrain treadmill device 100, 300 of the present invention. Similarly, as used herein "tread belt", "turf and terrain tread belt", and "turf tread belt" are interchangeable and refer to the artificial terrain surface tread belt or tread area 104, 302 of the present invention.

Notwithstanding the forgoing, the turf and terrain treadmill device 100, 300 and the artificial terrain surface tread belt or tread area 104, 302 of the present invention can be of any suitable size and configuration as is known in the art without affecting the overall concept of the invention, provided that it accomplishes the above stated objectives. One of ordinary skill in the art will appreciate that the turf and terrain treadmill device 100, 300 and the artificial terrain surface tread belt or tread area 104, 302 as shown in the FIGS. are for illustrative purposes only, and that many other sizes and shapes of the turf and terrain treadmill device 100, 300 and the artificial terrain surface tread belt or tread area 104, 302 are well within the scope of the present disclosure. Although the dimensions of the turf and terrain treadmill device 100, 300 and the artificial terrain surface tread belt or tread area 104, 302 are important design parameters for user convenience, the turf and terrain treadmill device 100, 300 and the artificial terrain surface tread belt or tread area 104, 302 be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A turf and terrain treadmill device comprising:

a treadmill having a deck including an uneven terrain tread belt providing an uneven walking surface for a user;

wherein said uneven walking surface is a turf;

wherein said uneven terrain tread belt disposed between a first pulley and a second pulley;

wherein said first pulley and said second pulley rotatable for moving and rotating said uneven terrain tread belt therebetween; and wherein said height of turf is adjustable to simulate an adjustable height for the artificial grass surface.

2. The turf and terrain treadmill device of claim 1, wherein said uneven terrain tread belt is a tread area having a width from about 4 feet to about 10 feet.

3. The turf and terrain treadmill device of claim 2, wherein said uneven terrain tread belt is a tread area having a length from about 6 feet to about 20 feet.

4. The turf and terrain treadmill device of claim 1, wherein said artificial grass includes a height from about 50 mm to about 130 mm.

5. The turf and terrain treadmill device of claim 1 further comprising a console and a screen for displaying a visual imitation of said uneven walking surface.

6. The turf and terrain treadmill device of claim 5, wherein said visual imitation is a virtual representation of said uneven walking surface.

7. The turf and terrain treadmill device of claim 5, wherein said console having a function for adjusting a speed of said uneven terrain tread belt.

8. The turf and terrain treadmill device of claim 7, wherein said console having another function for adjusting an angle of inclination of said uneven terrain tread belt.

9. The turf and terrain treadmill device of claim 1, wherein said uneven terrain tread belt interchangeable with another tread belt, and further wherein said uneven walking surface of said uneven terrain tread belt different from an uneven surface of said another tread belt.

10. The turf and terrain treadmill device of claim 1, wherein said rocky surface includes a plurality of unequal sized rocks.

11. The turf and terrain treadmill device of claim 1, wherein said gravel surface includes a plurality of pebbles.

12. The turf and terrain treadmill device of claim 1, wherein said uneven terrain tread belt having a plurality of barriers for stepping around.

13. A turf and terrain treadmill device comprising:

a treadmill having a deck including an uneven terrain tread belt providing an uneven walking surface for a user;

wherein said uneven walking surface is a turf;

wherein said uneven terrain tread belt disposed between a first pulley and a second pulley;

wherein said first pulley and said second pulley rotatable for moving and rotating said uneven terrain tread belt therebetween; and wherein said uneven terrain tread belt having a multi-layered configuration with a bottom shock pad layer for providing cushioning to the user; and wherein said height of turf is adjustable to simulate an adjustable height for the artificial grass surface.

14. The turf and terrain treadmill device of claim 13, wherein said uneven terrain tread belt having a backing layer above said shock pad layer.

15. The turf and terrain treadmill device of claim 14, wherein said uneven terrain tread belt having an infill layer above said backing layer.

16. The turf and terrain treadmill device of claim 15, wherein said uneven terrain tread belt having a yarn layer above said infill layer.

17. A turf and terrain treadmill device comprising:

a treadmill having a deck including an uneven terrain tread belt providing an uneven walking surface for a user;

wherein said uneven walking surface is a turf;

wherein said uneven terrain tread belt disposed between a first pulley and a second pulley;

wherein said first pulley and said second pulley rotatable for moving and rotating said uneven terrain tread belt therebetween; and wherein said uneven terrain tread belt having a multi-layered configuration with a bottom shock pad layer for providing cushioning to the user, a backing layer above said shock pad layer, an infill layer above said backing layer, and said uneven walking surface layer above said infill layer; and wherein said height of turf is adjustable to simulate an adjustable height for the artificial grass surface.

18. The turf and terrain treadmill device of claim 17, wherein said rocky surface includes a plurality of unequal sized rocks.

* * * * *